US009409366B1

(12) United States Patent
Dirks et al.

(10) Patent No.: US 9,409,366 B1
(45) Date of Patent: Aug. 9, 2016

(54) COMPACTOR AND COMPACTING METHOD FOR A LOOSE LIGHTWEIGHT MATERIAL

(71) Applicants: Jay Dean Dirks, Moscow, ID (US); Preston Wayne Schmidt, Potlatch, ID (US); Amos Troy Dirks, Potlach, ID (US)

(72) Inventors: Jay Dean Dirks, Moscow, ID (US); Preston Wayne Schmidt, Potlatch, ID (US); Amos Troy Dirks, Potlach, ID (US)

(73) Assignee: Schmidt & Dirks Designs, Inc., Moscow (ID)

( * ) Notice: Subject to any disclaimer, the term of this patent is extended or adjusted under 35 U.S.C. 154(b) by 46 days.

(21) Appl. No.: 14/225,221

(22) Filed: Mar. 25, 2014

Related U.S. Application Data

(60) Provisional application No. 61/852,890, filed on Mar. 25, 2013.

(51) Int. Cl.

| | |
|---|---|
| ***B30B 9/30*** | (2006.01) |
| ***B30B 11/22*** | (2006.01) |
| ***B30B 11/24*** | (2006.01) |
| ***B30B 13/00*** | (2006.01) |
| ***B30B 9/16*** | (2006.01) |
| ***B30B 9/12*** | (2006.01) |

(52) U.S. Cl.

CPC ..... *B30B 9/163* (2013.01); *B30B 9/127* (2013.01); *B30B 9/3025* (2013.01); *B30B 9/3082* (2013.01); *B30B 9/3089* (2013.01); *B30B 11/225* (2013.01); *B30B 11/24* (2013.01); *B30B 11/245* (2013.01); *B30B 11/246* (2013.01); *B30B 13/00* (2013.01)

(58) Field of Classification Search

CPC ..... B30B 9/127; B30B 9/163; B30B 9/3025; B30B 9/3082; B30B 9/3089; B30B 11/24; B30B 11/245; B30B 11/246; B30B 13/00; B30B 15/308; B30B 9/18; B30B 11/248; B30B 11/225; B30B 11/241; A01D 43/0633; A01D 46/005; A01D 46/084; A01D 89/00; A01F 15/00; A01F 15/0825; B65F 1/127; B32B 37/1018; B32B 37/10; B32B 37/1009

USPC ..... 100/35, 41, 90, 98 R, 117, 145, 146, 100/147, 148, 149, 150

See application file for complete search history.

(56) References Cited

U.S. PATENT DOCUMENTS

| | | | | | |
|---|---|---|---|---|---|
| 3,233,396 | A * | 2/1966 | Gallo | A01D 46/005 | 426/809 |
| 3,991,668 | A * | 11/1976 | De Milt | B30B 9/3082 | 100/147 |
| 4,019,219 | A * | 4/1977 | Willenborg | E01H 1/0836 | 15/339 |
| 4,180,390 | A * | 12/1979 | Furstenberg | D01H 11/005 | 19/107 |
| 4,256,035 | A * | 3/1981 | Neufeldt | A01F 15/00 | 100/145 |
| 4,291,619 | A * | 9/1981 | Hunt | B30B 9/18 | 100/117 |
| 4,561,145 | A * | 12/1985 | Latham | E01C 23/08 | 15/340.3 |
| 5,452,492 | A * | 9/1995 | Hamilton | B30B 9/121 | 15/340.1 |
| 7,267,051 | B2 * | 9/2007 | Richman | A01D 46/084 | 100/146 |
| 2005/0098049 | A1 * | 5/2005 | Shepherd | B30B 9/12 | 100/117 |

* cited by examiner

*Primary Examiner* — Jimmy T Nguyen

(74) *Attorney, Agent, or Firm* — Patent Law & Venture Group; Gene Scott

(57) ABSTRACT

A compacting apparatus for a light weight loose material has a chamber for receiving the material and an auger for driving the material into a compression tube. During initialization, a plug in the tube impedes the material to cause a compact material plug to form which restricts further loose material in a continuous compacting action. A spring loaded restrictor partially occludes the compression tube for impeding the compacted material in a compression action to thereby form a compressed plug of the loose material continuously.

15 Claims, 6 Drawing Sheets

COMPACTOR AND COMPACTING METHOD FOR A LOOSE LIGHTWEIGHT MATERIAL

BACKGROUND

The industrial field of this disclosure relates to apparatus for the compressing or compacting of loose materials into a more compact size with higher density. Generally, a compactor is a machine or mechanism used to reduce the size of waste material or soil through a pressing process. A trash compactor is often used by homes and businesses to reduce the volume of trash. In landfill sites for example, a large bulldozer with spiked wheels called a landfill compactor is used to drive over waste thereby pressing it down. Waste collection vehicles may incorporate a compacting mechanism which is used to increase the amount of waste the vehicle can accommodate, and to thereby reduce the number of times it has to be emptied. This usually takes the form of hydraulically powered sliding plates which sweep out a collection hopper and compress the material into what has already been loaded. Compactors are used in scrap metal processing, the most familiar being the car crusher. Such devices can either be of the "pancake" type, where a scrap automobile is flattened by a descending hydraulically powered plate. The other type is the baling press, where the automobile is compressed from several directions until it resembles a large cube.

Many retail and service businesses, such as fast food, restaurants, and hotels, use compactors to reduce the volume of non-recyclable waste as well as to eliminate curb nuisances such as rodents and odors. These compactors typically use electric or hydraulic operation, and have various loading configurations including, "ground-access," "walk-on," and "secured indoor chute." These compactors are almost exclusively of welded steel construction for: durability under pressure and exposure to the elements. There are also trash compactors, hydraulic or manual, designed for residential use to reduce the volume of garbage. For example, some compactors reduce the volume of polystyrene by thirty times. There are solar-powered trash compactors that can hold the equivalent of 200 gallons of trash before they need to be emptied. In the construction industry, there are three main types of compactors: the "plate," the "jumping jack," and the "road roller." The latter type is used for compacting crushed rock for road beds, foundations, and slabs. The plate compactor, also known as a vibratory rammer, has a vibrating baseplate suitable for creating a level grade, while the jumping jack compactor has a smaller footprint and is used mainly to compact backfill in narrow trenches. The presently disclosed compactor using a different means for compressing material and a unique method.

BRIEF DESCRIPTION OF DRAWINGS

Like reference symbols in the drawing figures indicate like elements.

DETAILED DESCRIPTION

Figure 1:
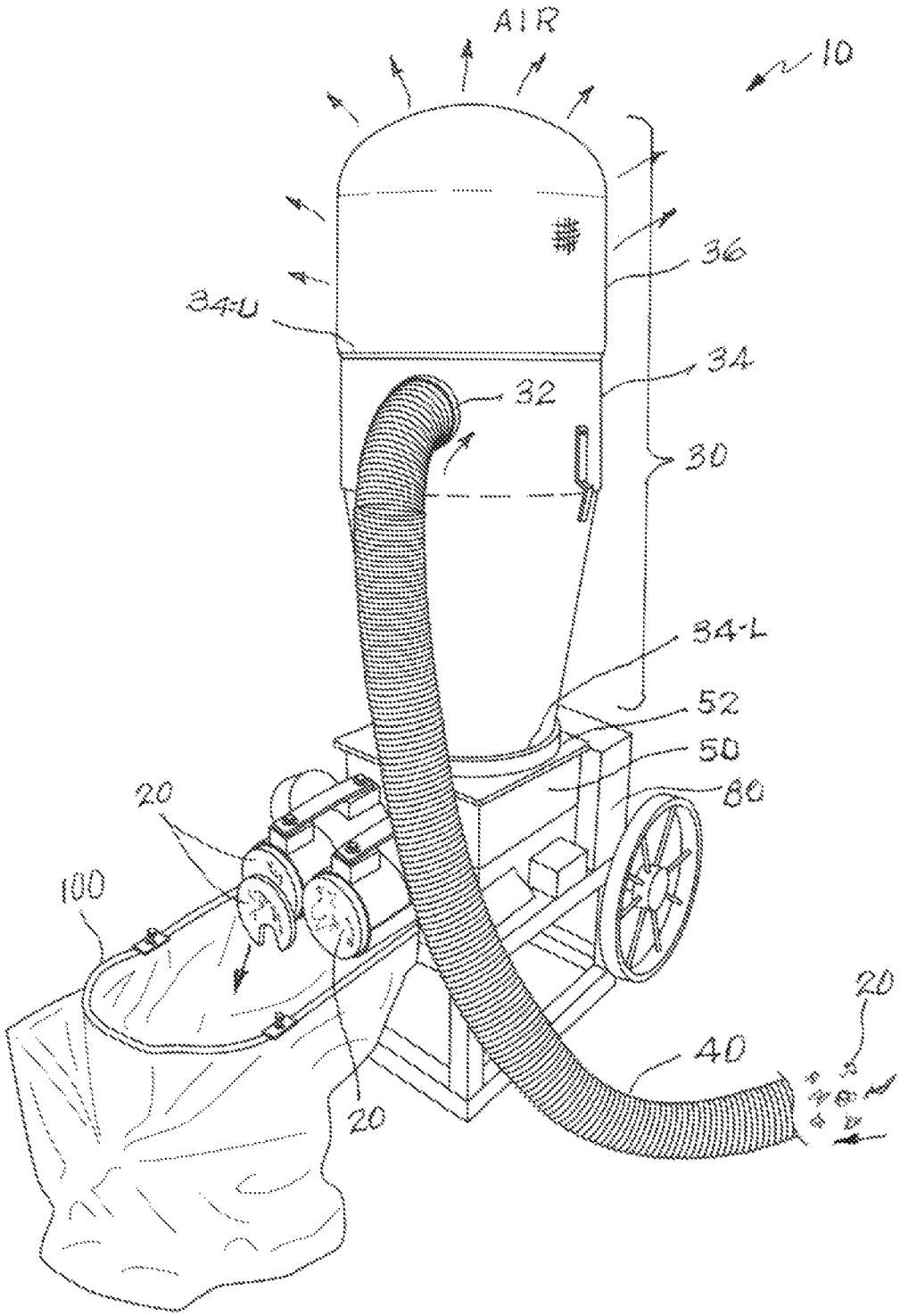
FIG. 1 is an example perspective view of a presently disclosed apparatus having dual compression tubes.

The presently described compacting apparatus (apparatus 10) is shown in the included drawings which are briefly described above. FIG. 1 is an overview of apparatus 10. Apparatus 10 is ideally used for compacting a low density loose material (material 20) such as a loose fiber, as for instance the solid parts, pieces, and shreds of solidified spray-on wall and ceiling insulation where such loose material 20 may be trimmed off the solidified insulation during finishing operations. Apparatus 10 may be effectively used for compacting other kinds and types of materials as well, and all such materials are meant by the term "material 20."

Figure 6:
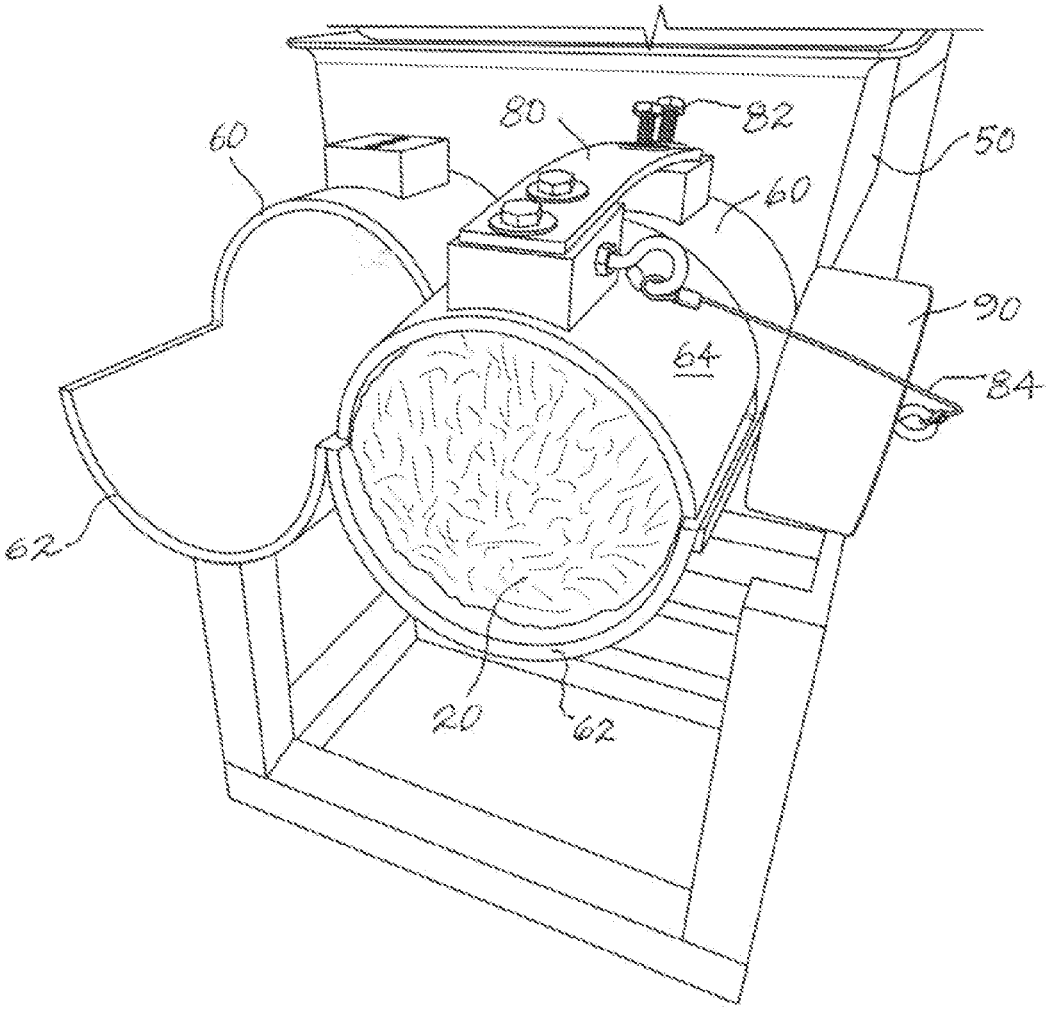
FIG. 6 is a perspective view of a compression tube showing a compressed material plug emerging therefrom and with the restrictor in contact with the plug.

In some embodiments apparatus 10 may have a hollow chamber (chamber 30) which may have an aperture 32 such as an inlet opening adapted by common attachment hardware for receiving a hose or tube (hose 40), as shown in FIG. 1. Material 20, in a loose form, may be carried into chamber 30 through aperture 32 by a forced air flow within hose 40, for instance as would be known to those of skill in the art, and also by other transport means. Chamber 30 may have a rigid lower portion 34 such as a sheet metal enclosure, as shown, and may further have an upper portion 36 of a filter fabric well known to those of skill in the art. The lower 34 and upper 36 portions of chamber 30 may be mutually joined by common hardware at an upper opening 34-U of lower portion 32. A lower opening 34-L of lower portion 32 may be secured to an opening 52 in an auger housing (housing 50) by common hardware. Chamber 30 and housing 50 form a fully enclosed space open only to aperture 32 which receives material 20 into chamber 30 and one or more compression tubes (tube 60), to be described, which may be used for compressing and expelling material 20 from housing 50 in a compressed block form as shown in FIG. 6. FIG. 1 also shows material 20 exiting a tube 60 in compressed block form.

Figure 2:
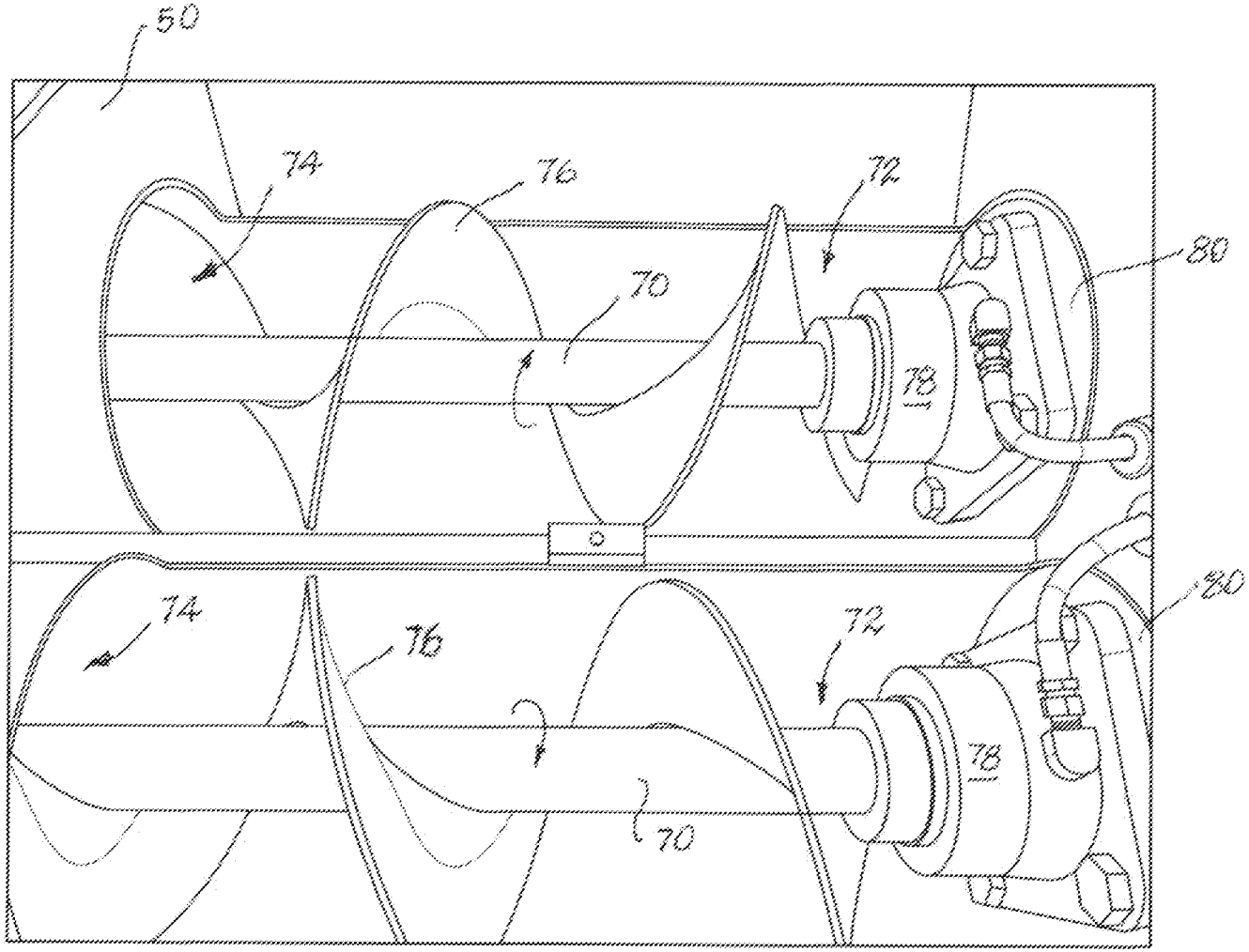
FIG. 2 is an interior perspective view of an auger housing thereof showing dual augers in side-by-side positions.
Figure 3:
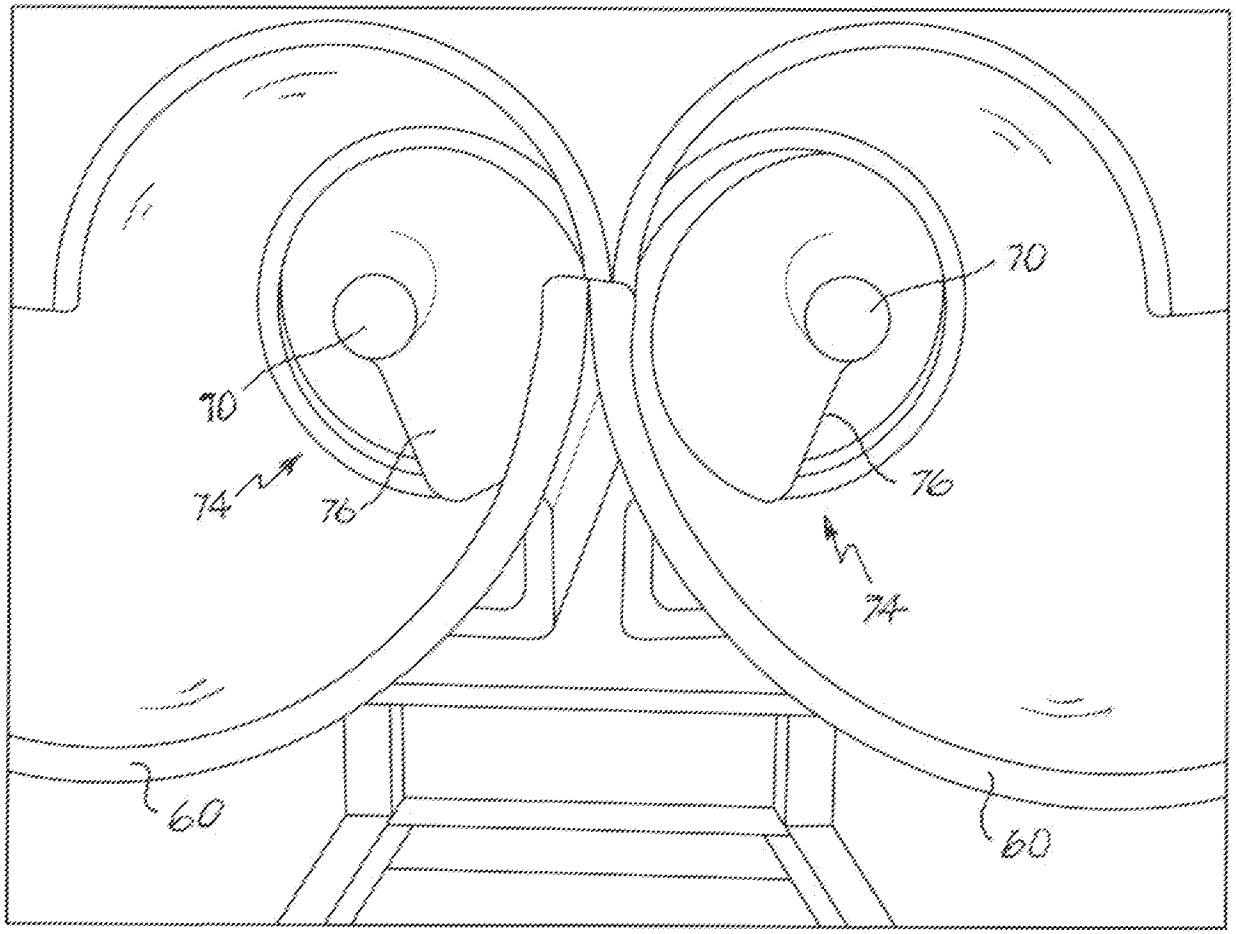
FIG. 3 is a perspective view of the compression tubes showing distal ends of the dual augers therein.

Housing 50 may engage, rotationally mounted therein, at least one auger 70. A pair of said auger 70 may be mounted within housing 50 as shown in FIG. 2. Additional augers may be applied. Each auger 70 may be engaged at one end (proximal end 72) with a rotary driver (driver 80) and at an opposite end (distal end 74) with a tube 60 as shown in FIG. 3. It should be noticed, in FIG. 2, that auger flights 76 of the two augers 70 are coiled in opposing senses and rotate in opposing rotational directions as well, as shown by the arrows in FIG. 2. This has an important function wherein flights of the augers moving in said counter-rotating action impel the loose material in opposing lateral directions so that material 10 does not favor one of the augers over the other enabling uniform material handling between the two augers. Material 10 moves down side walls of housing 50 directly into a pulling side of each auger 70. This improves the handling of material 10 since it is extremely light weight and has a tendency to bridge thereby starving the rotating augers 70.

Driver 80 may be any rotational impeller including electric motors, liquid fuel powered engines, or wind or water driven apparatus, as just a few possibilities, and such a driver 80 may be applied as a direct drive or may use a mechanical take-off using gears, belts, etc. Such drive applications will be known to those of skill in the art. At their proximal ends 72 augers 70 may be supported in bearing mounts 78 as shown or by appropriate alternate rotational supporting means as is known in the mechanical arts.

In one aspect of a method of use of apparatus 10, material 20, in a loose, low density form, is suctioned into hose 40 as shown in FIG. 1. Such suction may be applied by any vacuuming device wherein material 20 may then be blown through hose 40 to chamber 30 through aperture 32. It is well known to transport light disbursed materials, as for instance injection molding resin pellets, by suction and air driven blowing. In like manner, material 20, in its loose form, may be picked up and blown into chamber 30. As shown in FIG. 1, lower portion 34 of chamber 30 may have a funnel shaped aspect so that entering air and entrained material 20 in its loose form tends to circulate in a spinning motion within the funnel shaped aspect of portion 34 forming a funnel-confirmation. Material 20, being heavier than the air carrying it, is pushed toward the walls of chamber 30 thereby aggregating while the released air rises centrally moving upward and out of chamber 30 through the fabric material of upper portion 36. The arrows shown at the top of FIG. 1 indicate and represent escaping air. Material 20 settles downwardly, as further material 20 creates a downward pressure, and falls into augers 70. Augers 70 continually move material 20 in its loose form into tubes 60.

Figure 4:
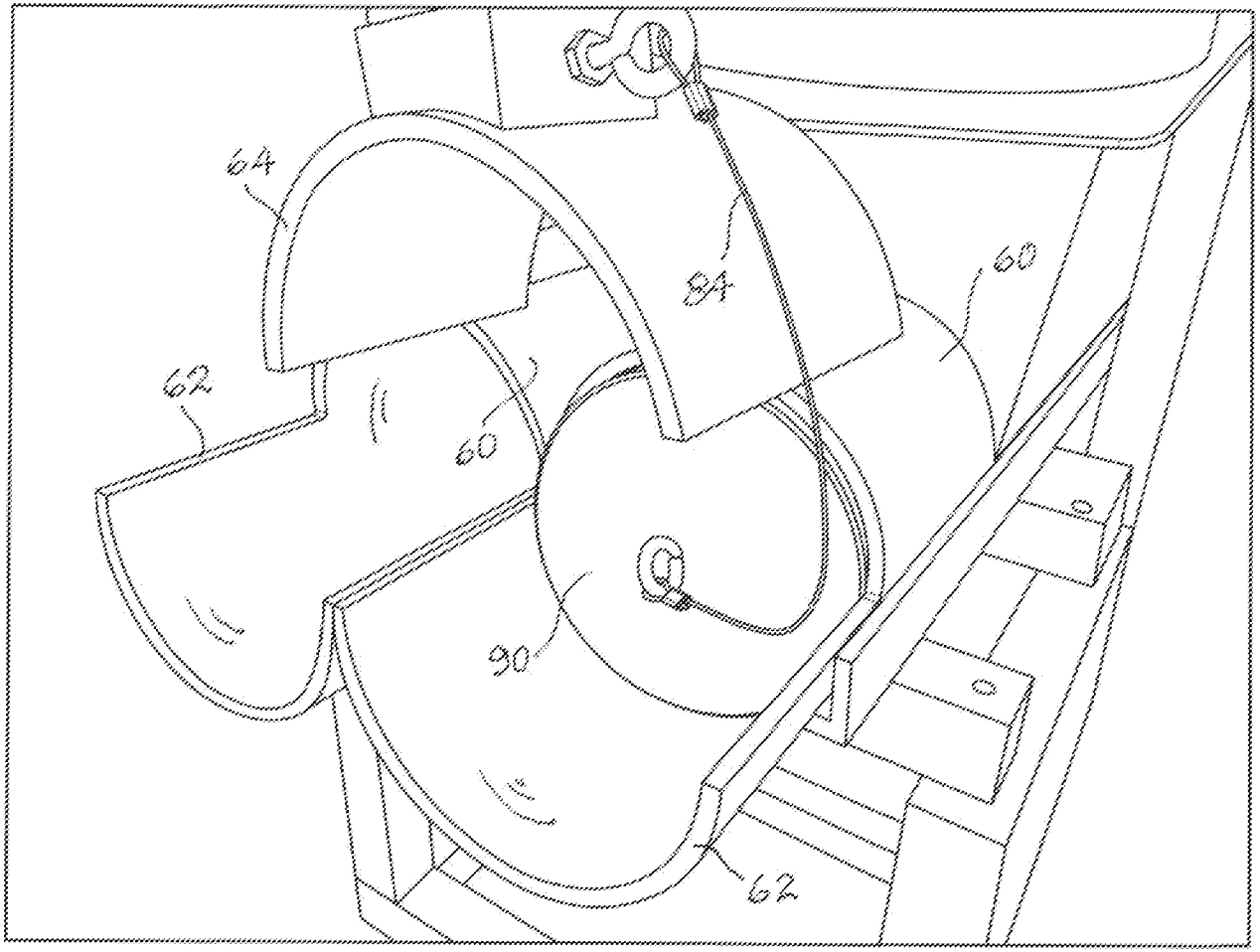
FIG. 4 is a perspective view showing a starter plug positioned in a compression tube and a restrictor position above it.
Figure 5:
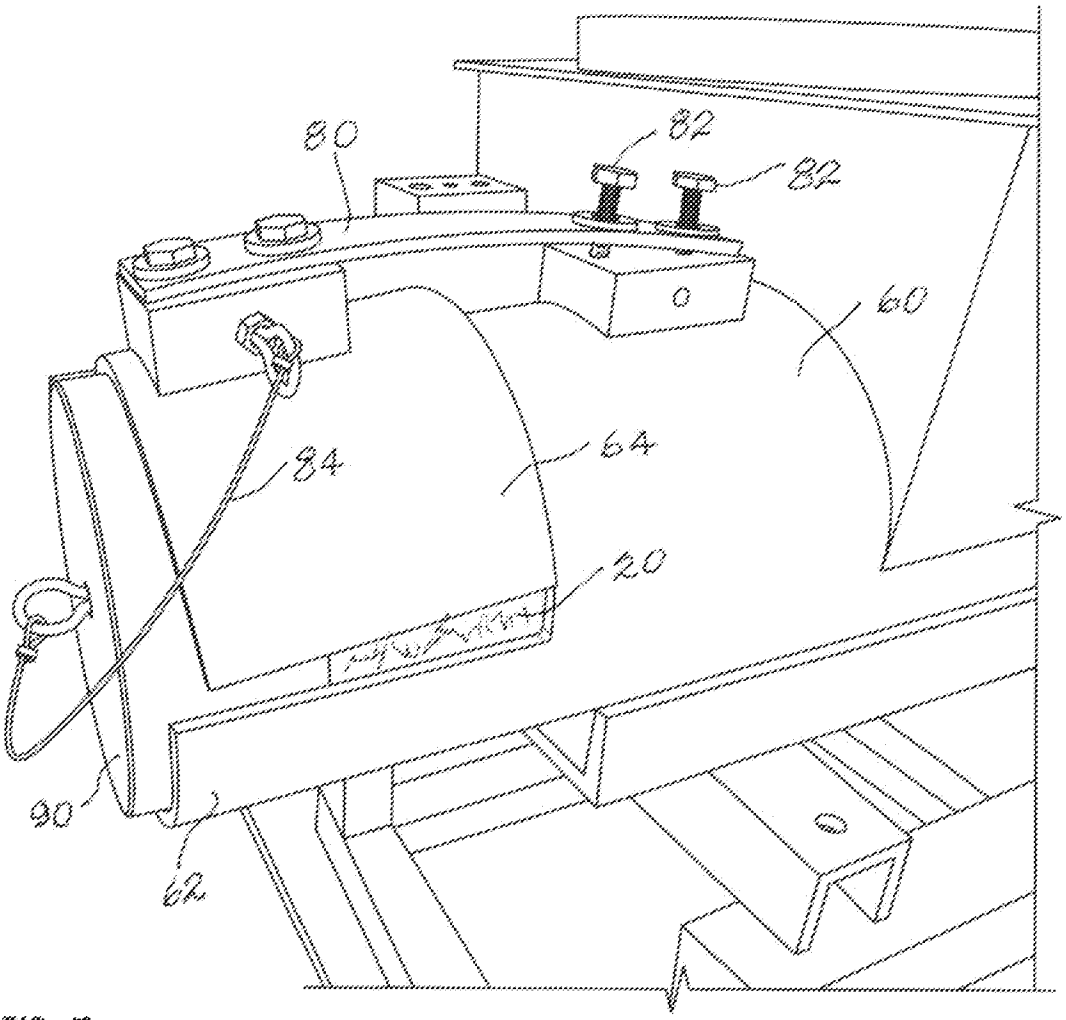
FIG. 5 is a perspective view of a compression tube with the restrictor shown in contact with the starter plug.

As shown in FIG. 4, tubes 60 may be round and terminal portions 62 of tubes 60 may be cut away longitudinally leaving a bottom, near-semicircular half, in place while removing an upper half. A restrictor 64 may be cantilevered out longitudinally, and held in place by a spring 80, in a position over terminal portion 62. During startup of operations restrictor 64 may be lowered into contact with a starter plug (plug 90), as shown in FIG. 5, and later into contact with compressed material 10 as shown in FIG. 6. Spring 80 applies a downward force on restrictor 64 which, in turn, applies this force to plug 90 and also to compressed material 10 as it emerges from tube 60. The downward spring force applied by spring 80 may be adjusted using mounting screws 82.

An initial step of the method of use of apparatus 10 includes placing plug 90 into tube 60 as shown in FIG. 4. This may be accomplished when restrictor 64 is in a raised position as shown. In a further aspect of the method of use of apparatus 10, as loose material 20 continuously fills auger 70 it is driven by the rotation of auger 70 into tube 60. With plug 90 in place and with restrictor 64 pressing down on plug 90 material 20 emerging from tube 60 is pressed by auger 70 against plug 90 in a compacting action. For greater compaction, spring 80 is adjusted to press with a greater force onto plug 90 so that a greater force must be applied by auger 70. Once a compacted plug of material 20 is formed to a desired firmness in tube 60 it pushes plug 90 out of tube 60 and off terminal portion 62. Plug 90 may be tethered as shown using cable 84 so as to be available when initializing the method in the future. Once a first firm plug of material 20 has been formed in the terminal portion 62 of tube 60, the restrictor impedes its progress so that it acts to force a continuing compacting action. As shown in FIG. 1, as the firm plug of material 20 moves off terminal portion 62 it tends to shear under its own weight and may be collected in a container 100.

Embodiments of the subject apparatus and method have been described herein. Nevertheless, it will be understood that modifications by those of skill in the art may be made without departing from the spirit and understanding of this disclosure. Accordingly, other embodiments and approaches are within the scope of the following claims.

What is claimed is:

1. A compacting apparatus for a light weight loose material, the compacting apparatus comprising:

a chamber having an aperture for receiving the loose material carried into the chamber;

the chamber having a rigid lower portion and an upper portion of a filter fabric;

an auger housing secured to the rigid lower portion, said auger housing having rotationally mounted therein a first auger engaged at opposing ends thereof with a rotary driver and a first compression tube;

a starter plug inserted into the first compression tube; and a restrictor partially occluding a discharge opening of the first compression tube, whereby the loose material falls from the upper portion into the first auger and is transported thereby to the first compression tube wherein the loose material is compressed and moved in a compacted form to a receptacle.

2. The compacting apparatus of claim 1 further comprising a second auger engaged at opposing ends thereof with the rotary driver and a second compression tube.

3. The compacting apparatus of claim 2 wherein the augers are engaged with the rotary driver in mutual counter-rotation.

4. The compacting apparatus of claim 3 wherein the augers impel the loose material in opposing lateral directions and in a common direction into the compression tubes.

5. The compacting apparatus of claim 1 wherein a spring presses on the restrictor.

6. The compacting apparatus of claim 1 wherein the lower portion is funnel-shaped.

7. The compacting apparatus of claim 1 wherein the starter plug is of a rigid material.

8. A compacting apparatus for a light weight loose material, the compacting apparatus comprising:

a chamber having an aperture receiving the loose material into the chamber, the chamber having a filter fabric positioned above a rigid portion of the chamber;

the rigid portion engaged with an auger housing, said auger housing having a rotationally powered auger positioned for receiving the loose material;

a compression tube positioned for receiving the loose material from the auger;

a starter plug positionable within the compression tube; and a restrictor engaged by a spring, wherein the restrictor at least partially occludes the compression tube.

9. The compacting apparatus of claim 8 wherein the starter plug is of a rigid material and is of a circular shape enabling entry of the starter plug into the compression tube.

10. A compacting method for a light weight loose material, comprising:

forcing the loose material on an air flow into an auger housing below a filter fabric;

separating the loose material from the air flow and expelling the air flow through the filter fabric;

settling the loose material into an auger;

rotating the auger thereby forcing the loose material into a compression tube;

restricting movement of the loose material in the compression tube using a removable starter plug; and pressing on the loose material with a restrictor thereby producing a desired level of compaction of the loose material while allowing the loose material to move out of the compression tube in a compacted form.

11. The compacting method of claim 10 wherein settling of the loose material enters two augers within the auger housing.

12. The compacting method of claim 10 wherein the loose material enters two augers within the auger housing.

13. The compacting method of claim 10 wherein the rotating is of two augers.

14. The compacting method of claim 10 wherein the compressing of the loose material occurs in two compression tubes.

15. The compacting method of claim 14 wherein the impeding of the movement of the loose material is by restrictors in the compression tubes.

* * * * *